United States Patent [19]

Kuwahara

[11] Patent Number: 5,028,046

[45] Date of Patent: Jul. 2, 1991

[54] FEED PATH SELECTION MECHANISM FOR SHEETS OF PAPER CAPABLE OF BEING DRIVEN BY THE EXISTING DRIVE SYSTEM OF A PHOTOCOPIER OR THE LIKE

[75] Inventor: Tesshu Kuwahara, Yokohama, Japan

[73] Assignee: Kabushiki Kaisha Toshiba, Kawasaki, Japan

[21] Appl. No.: 411,042

[22] Filed: Sep. 22, 1989

[30] Foreign Application Priority Data

Sep. 30, 1988 [JP] Japan ..... 63-246221

[51] Int. Cl.[5] ..... B65H 39/10

[52] U.S. Cl. ..... 271/301; 271/303

[58] Field of Search ..... 271/301, 303, 304, 305

[56] References Cited

U.S. PATENT DOCUMENTS

| | | | |
|---|---|---|---|
| 1,942,872 | 1/1934 | Matthews | 271/303 X |
| 4,352,490 | 10/1982 | Hatakeyama | 271/303 X |
| 4,416,450 | 11/1983 | van Wijngaarden | 271/303 |

FOREIGN PATENT DOCUMENTS

| | | | |
|---|---|---|---|
| 40139 | 3/1980 | Japan | 271/305 |
| 210508 | 11/1968 | U.S.S.R. | 271/303 |
| 675117 | 7/1952 | United Kingdom | 271/305 |

*Primary Examiner*—Robert P. Olszewski
*Assistant Examiner*—Boris Milef
*Attorney, Agent, or Firm*—Cushman, Darby & Cushman

[57] ABSTRACT

An apparatus for selecting the feed path of sheets of paper capable of being driven by the constant rotation of the existing drive system of a photocopier, or the like. A gate is used for selectively directing paper to one of two feed path directions. The apparatus utilizes a frictional drive torque transfer mechanism that transmits a limited torque to the gate. When the gate is in the proper position, it is stopped by a stopper whose force exceeds the torque limit of the torque transfer mechanism allowing the gate to maintain the proper position while the drive system continues to rotate.

6 Claims, 4 Drawing Sheets

FEED PATH SELECTION MECHANISM FOR SHEETS OF PAPER CAPABLE OF BEING DRIVEN BY THE EXISTING DRIVE SYSTEM OF A PHOTOCOPIER OR THE LIKE

BACKGROUND OF THE INVENTION

1. Field of the Invention

The present invention relates to a feed path selection mechanism for sheets of paper or the like equipped with a selecting gate which selects the feed path of the sheets of paper or the like, and to an image forming apparatus using this mechanism.

2. Description of the Related Art

A conventional feed path selection mechanism for sheets of paper or the like in an image forming apparatus comprises a gate plate, a solenoid having a plunger which is operatively connected to the gate plate, and a solenoid driving circuit for actuating the solenoid. When the solenoid is excited, the plunger is retracted to rotate the gate plate in a first direction whereby the gate plate is stopped at the first position. This produces the gate open condition, allowing a sheet of paper that has been copied on to one side to be again fed to a loading unit for copying on both sides. On the other hand, when the excitation of the solenoid is removed, no attractive force is applied to the plunger. As a result, the gate plate is rotated in a second direction opposite to the first direction and stopped at the second position. This produces the gate closed condition, so that a sheet of paper, after having been copied on, is discharged to the outside of the apparatus.

In the conventional feed path selection mechanism as described above, the solenoid that is electrically actuated is used as the drive source of the gate plate. This therefore necessitated a solenoid, its mounting bracket, a connecting link, and a solenoid driving circuit etc, causing the problem of high cost. Also, extra space is required to mount the solenoid, resulting in the problem of increased size of the device as a whole.

SUMMARY OF THE INVENTION

It is an object of the present invention to provide a feed path selection mechanism wherein the selecting gate can be rotated utilizing the existing drive mechanism, and an image forming device employing this feed path selection mechanism.

According to the present invention, there is provided an apparatus for selecting the feed path of sheets of paper, comprising means for conveying the sheet of paper, the conveying means including a first feed path and a second feed path; gate means for selectively leading the sheets of paper to one of the first feed path and the second feed path; means for moving the gate means between a first position corresponding to the first feed path and a second position corresponding to the second feed path, the moving means including first transmitting means for transmitting a rotation torque in a first direction and a second direction opposite to the first direction to the gate means, the first transmitting means no rotation torque transmits to the gate means due to the first.transmitting means idles after the gate means moves to the first position by the rotation of the first transmitting means in one direction of the first and second direction; second transmitting means, operatively coupled to the first transmitting means, for transmitting a rotation torque to the first transmitting means, the second transmitting means no rotation torque transmits to the first transmitting means due to the second transmitting means idles after the gate means moves to the second position through the first transmitting means by the rotation of the second transmitting means in the other direction of the first and second direction; and means, operatively coupled to the second transmitting means, for selectively rotating the second transmitting means in the first direction and the second direction; wherein the sheets of paper being led to the first path when the moving means moves the gate means to the first position, and being led to the second path when the moving means moves the gate means to the second position.

BRIEF DESCRIPTION OF THE DRAWINGS

FIGS. 1 to 8 show an embodiment of a feed path selection mechanism according to the present invention in which:

FIG. 1 is a diagram showing the gate closed condition of the feed path selection mechanism provided in the image forming apparatus;

FIG. 2 is a diagram showing the gate open condition of the feed path selection mechanism provided in the image forming apparatus shown in FIG. 1;

FIG. 3 is a perspective view showing the feed path selection mechanism;

FIG. 4 is a perspective view showing the pulley drive mechanism portion of the feed path selection mechanism;

FIG. 5 is a plan view showing the vicinity of the selecting gate and rotatable shaft;

FIG. 6 is a flont view showing the relationship among the stopper, connecting body and gear body;

FIG. 7 is a perspective view showing the vicinity of the selecting gate; and FIG. 8 is a front view showing part A of FIG. 7 to a lager scale.

DETAILED DESCRIPTION OF THE PREFERRED EMBODIMENTS

A preferred embodiment of the present invention will now be described in more detail with reference to the accompanying drawings.

Figure 1:
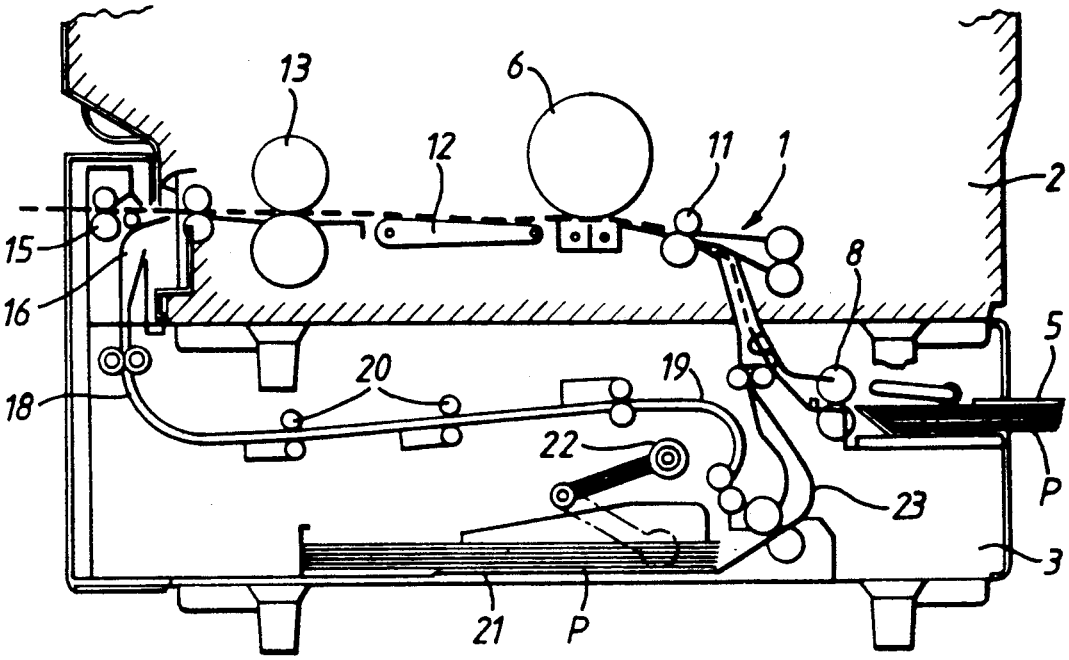
Figure 2:
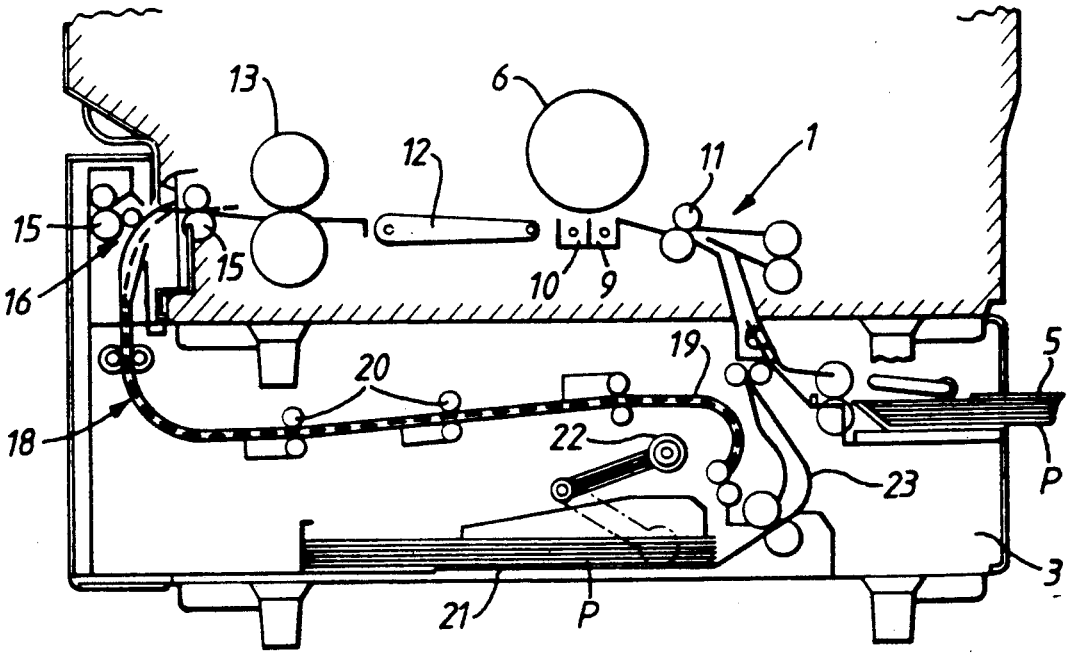

FIG. 1 is a diagram showing the gate closed condition of a feed path selection mechanism provided in an electronic copier 1 as an image forming apparatus. While, FIG. 2 is a diagram showing the gate open condition of the feed path selection mechanism. Electronic copier 1 is equipped with an upper unit 2 that accomodates the main body part of the copier, and a lower unit 3 provided below this upper unit 2. A paper feed cassette 5 is removably mounted in part of this lower unit 3. Within upper unit 2 and lower unit 3 there are provided: a photosensitive drum 6; feed rollers 8 that feed paper P held in paper feed cassette 5 in synchronization with the rotation of this photosensitive drum 6; a conveyor belt 12 that conveys copy paper P through aligning rollers 11 to photosensitive drum 6, this paper P then being separated from photosensitive drum 6 by a separation charger 10 after a toner image has been transferred to it by a transfer charger 9; a fixing roll pair 13 whereby the toner image is fixed to paper P, this fixing roll pair 13 provided at the end of this conveyor belt 12; and exit rollers 15 provided adjacent this fixing roll pair 13. Thus, copy paper P is discharged to the outside by passing through this exit rollers 15 and a sheet feed path selection mechanism 16.

Within lower unit 3 there is provided a feed loop 18 that communicates with the paper discharge end of the interior of upper unit 2. This loop 18 comprises an inverting paper feed guide 19 and a plurality of conveyor roll pairs 20 that face each other on either side of this inverting paper feed guide 19. A paper stack unit 21 is arranged in the middle of lower unit 3. Paper P that is drawn into conveyor loop 18 is temporarily stored in a stacked condition in paper stack unit 21, and is then again fed to photosensitive drum 6 by means of a pick up roll 22. At the discharge end of paper stack unit 21, there is provided a paper feed guide 23 that communicates with the paper feed end in upper unit 2.

Figure 3:
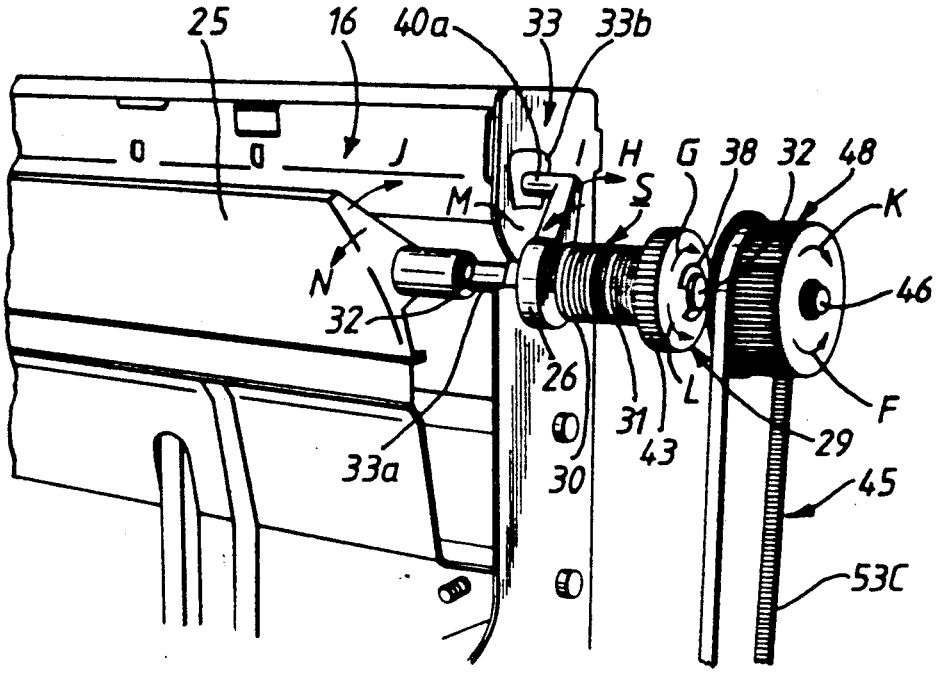
Figure 4:
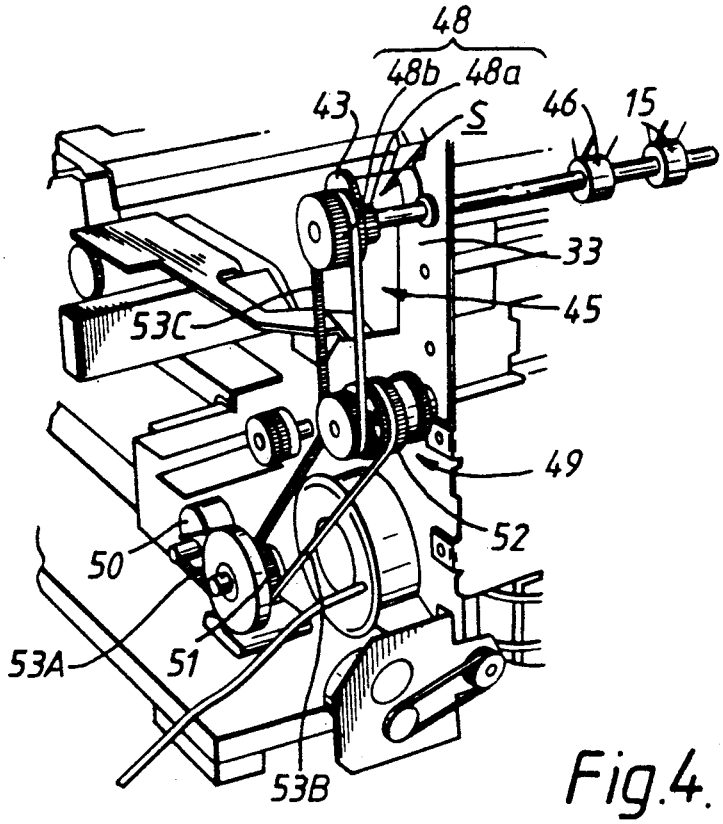
Figure 5:
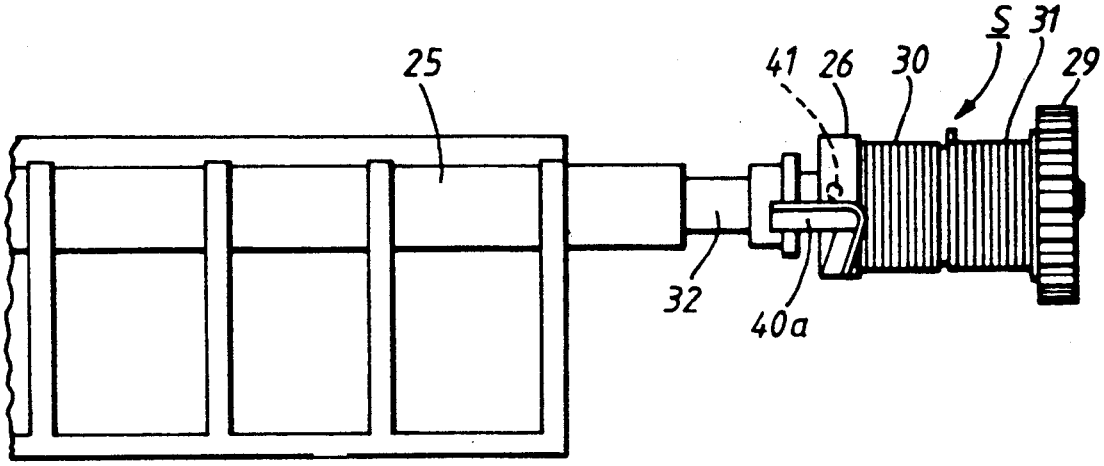
Figure 6:
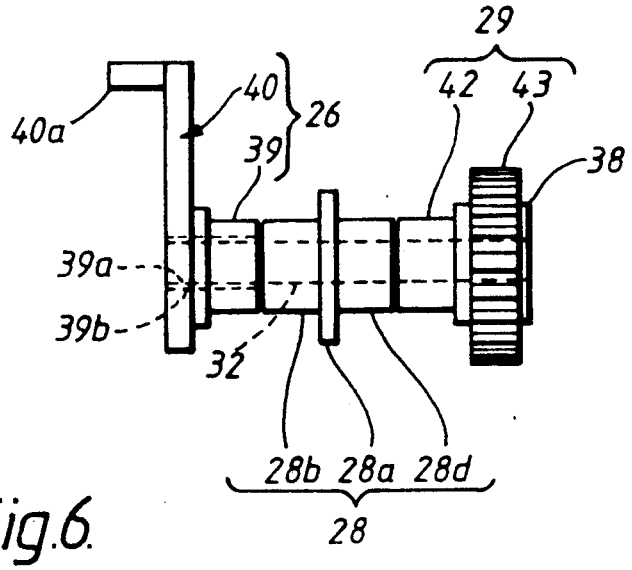
Figure 7:
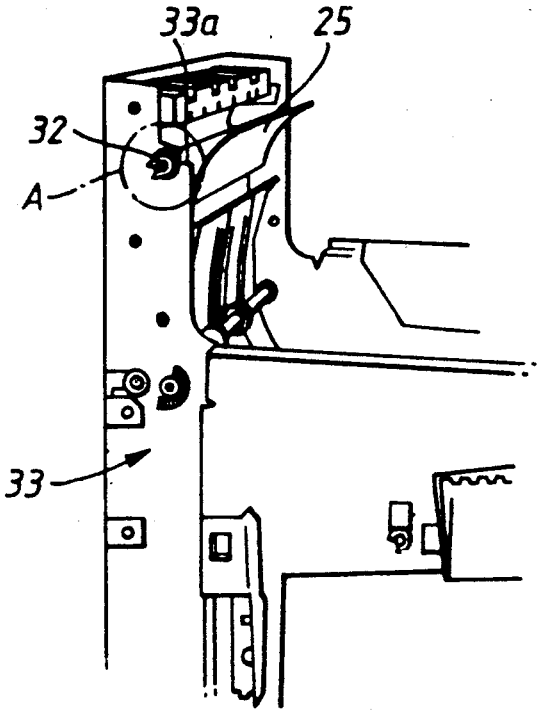
Figure 8:
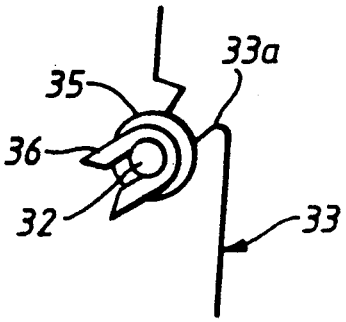

FIG. 3 is a perspective view showing the feed path selection mechanism. FIG. 4 is a perspective view showing the pulley drive mechanism portion of the feed path selection mechanism. FIG. 5 is a plan view showing the visinity of the selecting gate and rotatable shaft. FIG. 6 is a front view showing the relationship among the stopper, connecting body and gear body. FIG. 7 is a perspective view showing the vicinity of the selecting gate. FIG. 8 is a front view showing part A of FIG. 7 to a lager scale.

Paper feed path selection mechanism 16 is arranged between exit rollers 15 and the start of coveyor loop 18, and is equipped with a torque limiter S comprising a gate plate 25, a stopper 26, a cylindrical connector 28, a gear 29, a first coil spring 30, and a second coil spring 31.

Gate plate 25 is arranged in the direction normal to the plane of FIG. 1, and has a rotatable shaft 32 integrally fixed at its center of rotation. This rotatable shaft 32 is inserted in a slot 33*a* formed in the side of a frame 33 (see FIG. 8), so that it is rotatably supported in frame 33, movement in the axial direction being prevented by means of a clip 36 through a washer 35 on a ring shaped groove formed in a portion projecting from this slot 33*a*. Stopper 26, cylindrical connector 28, and gear 29 are successively mounted on the end of rotatable shaft 32 that projects from slot 33*a*. Movement of these components in the axis direction is prevented by means of a clip 38 that is pressed into a ring shaped groove formed at one end of rotatable shaft 32.

Stopper 26 comprises a cylindrical boss 39, which is 14 mm in outside diameter, and an arm 40 that projects from the outer circumference of this cylindrical boss 39. Rotatable shaft 32 is inserted into a shaft hole 39*a* formed in the middle of cylindrical boss 39, and pins 41 mounted on rotatable shaft 32 are inserted in grooves 39*b* formed at an interval of 180° over the entire length of shaft hole 39*a*. Thus stopper 26 rotates integrally with rotatable shaft 32. At the tip of arm 40, there is integrally formed a stop pin 40*a* that is parallel with the axis of cylindrical boss 39 and that projects on the opposite side to cylindrical boss 39. This stop pin 40*a* is inserted in a fan-shaped slot 33*b* formed in frame 33 and consisting of an arc centered on the axis of rotatable shaft 32.

Cylindrical connector 28 is divided, by a flange 28*a* formed at its center, into a left cylindrical boss 28*b* and a right cylindrical boss 28*d*. The outside diameter of left cylindrical boss 28*b* and right cylindrical boss 28*d* are 14 mm, respectively. The end face of left cylindrical boss 28*b* abuts the end face of cylindrical boss 39 of stopper 26 and is mounted on supported shaft 32. Gear 29 comprises a cylindrical boss 42, which is 14 mm in outside diameter, and a gear portion 43. The end face of cylindrical boss 42 abuts the end face of right cylindrical boss 28*d* of cylindrical connector 28 and is mounted on rotatable shaft 32. A first coil spring 30, which is 13.7 mm in inside diameter, is firstwardly, e.g., leftwardly wound, so that the first coil spring 30 clamps cylindrical boss 39 of stopper 26 and left cylindrical boss 28*b* of cylindrical connector 28 respectively. A second coil spring 31, which is 13.7 mm in inside diameter, is secondwardly opposite to the firstward, e.g., rightwardly wound, so that the second coil spring 31 clamps right cylindrical boss 28*d* of cylindrical connector 28 and cylindrical boss 42 of gear 29 respectively. Gear portion 43 of gear 29 is linked to an exit roller drive mechanism 45, which thus constitutes the gear drive mechanism. This exit roller drive mechanism 45 is equipped with a rotary shaft 46, a pulley 48 provided with a gear portion, and a pulley drive mechanism 49. Pulley 48 is fixed to the end of rotary shaft 46 and is rotatably supported on frame 33. Pulley 48 comprises a gear portion 48*a* and pulley portion 48*b*. Exit roller 15 is fixed to rotary shaft 46. Gear portion 48*a* meshes with gear portion 43 of gear 29. Pulley drive mechanism 49 is equipped with a motor 50, a driven pulley 51 and an intermediate pulley 52. Respective belts 53A, 53B and 53C are provided between motor 50 and driven pulley 51, driven pulley 51 and intermediate pulley 52 and intermediate pulley 52 and pulley portion 48*b* of pulley 48.

The operation of the embodiment will be described. When motor 50 rotates in the forward direction, pulley 48 rotates in the direction of arrow F through belt 53A, driven pulley 51, belt 53B, intermediate pulley 52 and belt 53C. When this happens, gear 29, which meshes with gear portion 48*a* of pulley 48, of torque limiter S rotates in the direction of arrow G. In accordance with the rotation of gear 29, cylindrical connector 28 is rotated in the direction of arrow G integrally with second coil spring 31 since second coil spring 31, which is rightwardly wound, clamps the circumferential surface of right cylindrical boss 28*d*. By rotation of cylindrical connerctor 28, stopper 26 is rotated integrally with first coil spring 30 in the direction of arrow H until stop pin 40*a* abuts one end of slot 33*b* since first coil spring 30, which is leftwardly wound, clamps the circumferential surface of cylindrical boss 39 of stopper 26. Due to this rotation, gate plate 25 rotates in the direction of arrow J, assuming the gate open condition as shown in FIG. 2, and allowing paper P whereof one side has been copied on to be fed into conveyor loop 18 so that copying is performed on to both faces of paper P.

In this case, even if pulley 48 rotates further in the direction of arrow F, the open condition will be maintained since all that happens is that second coil spring 31 performs idle rotation over the circumference of right cylindrical boss 28*d*.

On the other hand, when motor 50 is rotated in the opposite direction, pulley 48 rotates in the direction of arrow K through belt 53A, driven pulley 51, belt 53B, intermediate pulley 52 and belt 53C. When this happens, gear 29 rotates in the direction of arrow L, causing stopper 28 is rotated in the direction of arrow L since second coil spring 31 clamps the circumferential surface of right cylindrical boss 28*d* of cylindrical connector 28. By this rotation of cylindrical connector 28, stopper 26 is rotated integrally with first coil spring 30 in the direction of arrow M until stop pin 40*a* abuts the other end of slot 33*b* since first coil spring 30 clamps the circumferential surface of cylindrical boss 39 of stopper 26. This rotation causes gate plate 25 to be rotated in the direction of arrow N, producing the gate closed condition as shown in FIG. 2, so that after paper P has been copied to on one side, it can be discharged to the outside through exit rollers 15.

In this case, even if pulley 48 rotates further in the direction of arrow K, cylindrical connector 28 rotates idly over the inner surface of first coil spring 30, so the gate closed condition is maintained.

As described above, in selecting the paper feed path, the selecting gate is operated in the forwards or reverse direction by forward or reverse rotation of the torque limiter utilizing the existing drive mechanism, e.g., an exit roller drive mechanism 45.

Consequently, the construction can be greatly simplified, enabling a considerable cost reduction, and the entire device can be made smaller.

What is claimed is:

1. An apparatus for selecting the feed path of sheets of paper, comprising:

means for conveying the sheet of paper, the conveying means including a first feed path and a second feed path;

gate means for selectively leading the sheets of paper to one of the first feed path and the second feed path, the gate means including a frame having a slot therein, said slot defining a first edge and a second edge essentially opposite said first edge, the gate means also including a shaft rotatably mounted to said frame, a plate attached to said shaft and a stopper attached to said shaft positioned so as to abut said first edge when said first feed path is selected and so as to abut said second edge when said second feed path is selected;

moving means for moving said gate means between a first position corresponding to said first feed path and a second position corresponding to said second feed path, comprising:

first transmitting means capable of transmitting a limited torque in a first direction to said gate means, so as to rotate said shaft in said first direction direction until said stopper comes into contact with said first edge at which point a force exerted on said shaft by said stopper will exceed the torque limit of said first transmitting means causing said gate means to remain in said first position;

second transmitting means, operatively coupled to said first transmitting means, for transmitting a limited torque to said first transmitting means, so as to rotate said first transmitting means in a second direction, opposite said first direction, until said stopper comes into contact with said second edge at which point a force exerted on said shaft by said stopper will exceed the torque limit of said second transmitting means causing said gate means to remain in said second position;

rotating means operatively coupled to said second transmitting means, for selectively rotating said second transmitting means in said first direction and said second direction;

said sheets of paper being directed to said first feed path when said moving means moves said gate means to the first position, and said sheets of paper being directed to said second feed path when the moving means moves the gate means to the second position.

2. The apparatus of claim 1 wherein the first transmitting means including:

a first cylindrical boss securely mounted to the rotatable shaft;

a cylindrical connector including a flange, a second cylindrical boss projecting from one side of the flange to be adjoined the first cylindrical boss, and a third cylindrical boss projecting from the other side of the flange, the connector being rotatably mounted on the rotatable shaft; and a first coil spring, which is wound in the first direction, for covering on the first and second cylindrical bosses in frictional contact with the circumference of the first and second cylindrical bosses.

3. The apparatus of claim 2 wherein the second transmitting means including:

a fourth cylindrical boss rotatably mounted on the rotatable shaft to be adjoined the third cylindrical boss, the fourth cylindrical boss being connected to the driving means to be selectively rotated in the first and second direction; and a second coil spring, which is wound in the second direction opposite to the first direction, for covering on the third and fourth cylindrical bosses in frictional contact with the circumference of the third and fourth cylindrical bosses.

4. An image forming apparatus including means for forming an image on a sheet of paper, comprising:

conveying means for conveying the sheet of paper on which the image is formed by said image forming means;

a first feed path for discharging the sheet of paper conveyed by said conveying means to an outside portion of the apparatus;

a second feed path, diverged from said conveying means, for feeding the sheet of paper on which the image is formed by the image forming means for further forming an additional image on the sheet of paper, to the image forming means;

gate means for selectively leading the sheets of paper to one of said first feed path and said second feed path, the gate means including a frame having a slot therein defining a first edge and a second edge facing said first edge, a rotatable shaft rotatably mounted to said frame, a gate plate mounted to said rotatable shaft, and a stopper secured to said rotatable shaft for abutting the first edge of the slot to stop the gate plate at a first position and abutting the second edge of the slot to stop the gate plate at a second position;

means for moving said gate means between the first position corresponding to said first feed path and the second position corresponding to said second feed path, comprising:

first transmitting means capable of transmitting a limited torque, in a first direction to said gate means, so as to rotate said shaft in said first direction until said stopper comes into contact with said first edge at which point a force exerted on said shaft by said stopper will exceed the torque limit of said first transmitting means causing said gate means to remain in said first position;

second transmitting means, operatively coupled to said first transmitting means, for transmitting a limited torque to said first transmitting means, so as to rotate said first transmitting means in said second direction until said stopper comes into contact with said second edge at which point a force exerted on said shaft by said stopper will exceed the torque limit of said second transmitting means causing said gate means to remain in said second position; and rotating means, operatively coupled to said second transmitting means, for selectively rotating said second transmitting means in said first direction and said second direction;

said sheet of paper being directed to said first path when said moving means moves said gate means to said first position, and being directed to said second path when said moving means moves said gate means to said second position.

5. The apparatus of claim 4 wherein the first transmitting means including:

a first cylindrical boss securely mounted to the rotatable shaft;

a cylindrical connector including a flange, a second cylindrical boss projecting from one side of the flange to be adjoined the first cylindrical boss, and a third cylindrical boss projecting from the other side of the flange, the connector being rotatably mounted on the rotatable shaft; and a first coil spring, which is wound in the first direction, for covering on the first and second cylindrical bosses in frictional contact with the circumference of the first and second cylindrical bosses.

6. The apparatus of claim 5 wherein the second transmitting means including:

a fourth cylindrical boss rotatably mounted on the rotatable shaft to be adjoined the third cylindrical boss, the fourth cylindrical boss being connected to the driving means to be selectively rotated in the first and second direction; and a second coil spring, which is wound in the second direction opposite to the first direction, for covering on the third and fourth cylindrical bosses in frictional contact with the circumference of the third and fourth cylindrical bosses.

* * * * *